US009462372B2

(12) United States Patent
Akino

(10) Patent No.: US 9,462,372 B2
(45) Date of Patent: Oct. 4, 2016

(54) UNIDIRECTIONAL CONDENSER MICROPHONE UNIT

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/872,547

(22) Filed: Oct. 1, 2015

(65) Prior Publication Data

US 2016/0100246 A1 Apr. 7, 2016

(30) Foreign Application Priority Data

Oct. 7, 2014 (JP) ..... 2014-206520

(51) Int. Cl.

| | |
|---|---|
| ***H04R 9/08*** | (2006.01) |
| ***H04R 1/22*** | (2006.01) |
| ***H04R 19/04*** | (2006.01) |
| *H04R 1/40* | (2006.01) |
| *H04R 1/24* | (2006.01) |
| *H04R 1/32* | (2006.01) |

(52) U.S. Cl.

CPC ..... *H04R 1/222* (2013.01); *H04R 19/04* (2013.01); *H04R 1/245* (2013.01); *H04R 1/326* (2013.01); *H04R 1/406* (2013.01)

(58) Field of Classification Search

CPC ..... H04R 1/245; H04R 1/326; H04R 1/406; H04R 19/04

See application file for complete search history.

(56) References Cited

U.S. PATENT DOCUMENTS

| | | | | |
|---|---|---|---|---|
| 2,552,878 A * | 5/1951 | Wiggins | H04R 1/38 | 381/173 |
| 3,146,308 A * | 8/1964 | Gorike | H04R 1/406 | 307/400 |
| 3,588,382 A * | 6/1971 | Reedyk | H01G 7/02 | 307/400 |
| 8,265,304 B2 * | 9/2012 | Osborne | H04R 1/08 | 381/122 |
| 8,345,898 B2 * | 1/2013 | Reining | H04R 19/016 | 381/184 |
| 2008/0002837 A1 * | 1/2008 | Akino | H04R 19/04 | 381/92 |

FOREIGN PATENT DOCUMENTS

JP 2011-55062 A 3/2011

* cited by examiner

*Primary Examiner* — Curtis Kuntz
*Assistant Examiner* — Ryan Robinson
(74) *Attorney, Agent, or Firm* — Manabu Kanesaka

(57) ABSTRACT

A unidirectional condenser microphone includes a first and second condenser elements each having a diaphragm and a fixed electrode disposed opposite the diaphragm, an insulating base having an opening at the center thereof and supporting the respective fixed electrodes of the first and second condenser elements at opposite sides of the insulating base, acoustic resistance materials covering both ends of the opening, and air chambers formed respectively between each of the fixed electrodes and the insulating base, such that respective back sides of the diaphragms of the first and the second condenser elements are acoustically in communication with each other, wherein the diaphragm of the second condenser elements is formed to be an annular-shape having a central opening, and the second condenser element has a rear acoustic terminal hole communicating with the central opening.

5 Claims, 5 Drawing Sheets

UNIDIRECTIONAL CONDENSER MICROPHONE UNIT

RELATED APPLICATIONS

The present application is based on, and claims priority from, Japanese Application No. JP2014-206520 filed Oct. 7, 2014, the disclosure of which is hereby incorporated by reference herein in its entirety.

BACKGROUND OF THE INVENTION

1. Field of the Invention

The present invention relates to a unidirectional condenser microphone unit, more particularly to a unidirectional condenser microphone unit that can collect sounds in a lower frequency range by proximity effect depending on situations, even in the case where a diaphragm is placed on a rear acoustic terminal side of the condenser microphone unit.

2. Description of the Related Art

Generally, a unidirectional condenser microphone exhibits proximity effect. The proximity effect is an effect of rise of output level in a low sound range when a sound source, such as speakers' mouth, becomes close to the microphone. Sound collection using the proximity effect is often performed because a bass-rich voice can be collected therewith.

The proximity effect, however, causes a change of a lower frequency response depending on a distance from a sound source, and therefore, the proximity effect is undesirable when a sound quality should not be changed depending on the distance.

In order to solve the above problem, employed is a unidirectional condenser microphone having a diaphragm on a rear acoustic terminal, as shown in FIG. 9.

A condenser microphone unit 50 shown in FIG. 9 includes an insulating base 9 made of an electric insulator such as synthetic resin or ceramics, and a first and a second condenser element 51 and 52 supported by opposite sides of the insulating base 9. The condenser elements 51 and 52 are identical except being disposed laterally symmetrically. The condenser elements 51 and 52 include diaphragms 15 and 16 stretched with a predetermined tension over supporting rings 13 and 14 which are integrally formed on peripheral areas of resonators 11 and 12 made of metal plates.

Further, the diaphragms 15 and 16 are disposed opposite to fixed electrodes 19 and 20 through spacer rings 17 and 18. And peripheral portions on both sides of the insulating base 9 and peripheral portions of the resonators 11 and 12 are integrally assembled by connection rings 21 and 22.

The diaphragms 15 and 16 use synthetic resin thin films having a metal-, preferably gold, evaporated films on one side thereof. The fixed electrodes 19 and 20 are made of perforated metal plate having a large number of sound holes (not shown). Additionally, electret dielectric films may be provided on the fixed electrodes 19 and 20.

The resonator 11 and 12 include acoustic terminal holes 11*a* and 12*a* for collecting sound waves. A communication hole 9*a* is provided at the center of the insulating base 9, and both ends of the communication hole 9*a* are covered with acoustic resistance materials 23 and 24.

Further, air chambers A1 and A2 are provided between the fixed electrodes 19, 20 and the insulating base 9 in order to acquire velocity components through acoustic resistance materials 23 and 24. In an example shown in FIG. 9, tapered members 25 and 26 are disposed on the both side faces of the insulating base 9. The tapered members 25, 26 form conical surfaces with the acoustic resistance materials 23 and 24 as apex parts and the peripheral portions of the insulating base 9 as peripheries, and the air chambers A1 and A2 function as acoustic transducers having a speaker-cone-like shape.

FIG. 10 shows an equivalent circuit for a condenser microphone unit 50. Let the first condenser element 51 be on a front side, then P1 denotes a sound source on a side of the acoustic terminal hole 11*a*, $m_0f$ denotes mass of the diaphragm 15, $s_0f$ denotes stiffness of the diaphragm 15, $r_0f$ denotes an acoustic resistance, and $s_1$ denotes acoustic mass of the air chamber A1. And P2 denotes a sound source on a side of the acoustic terminal hole 12*a*, $m_0a$ denotes mass of the diaphragm 16, $s_0a$ denotes stiffness of the diaphragm 16, $r_0a$ denotes an acoustic resistance, and $s_2$ denotes acoustic mass of the air chamber A2. A resultant acoustic resistance of the acoustic resistance materials 23 and 24 is shown as $r_1$.

In the condenser microphone unit 50 of this structure, in the case where the sound source P1 is on a side of the first condenser microphone element 51, for example, sound waves P2 from the rear acoustic terminal 12*a* toward the first condenser element 51 comes through the diaphragm 16 ($m_0a$, $s_0a$, $r_0a$) of the second condenser element 52.

Therefore, because sound waves in low frequency range do not enter the first condenser element 51 side, the condenser microphone unit 50 performs as being omnidirectional and the proximity effect is hardly obtained. That is, this configuration is preferable for keeping the sound quality unchanged even though a distance from a sound source is changed.

A condenser microphone unit of this configuration was disclosed in Japanese Patent Application Laid-Open (JP-A) No. 2011-55062.

However, collection of bass-rich sound using the proximity effect is not achievable with the condenser microphone 50 shown in FIG. 9. Thus, depending on the situation, it is necessary to prepare other types of microphones with which the proximity effect is available.

SUMMARY OF THE INVENTION

The present invention has been made in view of the above-mentioned problems and an object of the invention is to provide a unidirectional microphone unit that can collect sounds in a lower frequency range by proximity effect, even in the case where a diaphragm is placed on a rear acoustic terminal side of the condenser microphone unit.

In order to solve the above-mentioned problem, the present invention provides a unidirectional microphone unit including: a first condenser element and a second condenser element, each including a diaphragm that is vibrated by sound waves and a fixed electrode having sound holes and disposed opposite the diaphragm; an insulating base having an opening at a center thereof and configured to support the respective fixed electrodes of the first and second condenser elements at opposite sides of the insulating base; acoustic resistance materials covering both ends of the opening of the insulating base; and air chambers formed respectively between each of the fixed electrodes and the insulating base, such that respective back sides of the diaphragms of the first and the second condenser elements are acoustically in communication with each other, wherein the diaphragm of the second condenser element is formed to be an annular-shape having a central opening, and the second condenser element has a rear acoustic terminal hole communicating with the central opening.

Additionally, the second condenser element is preferably provided with an opening/closing device for opening/closing the rear acoustic terminal hole communicating with the central opening of the diaphragm. Further, the opening/closing device is preferably configured such that a degree of opening of the rear acoustic terminal hole can be changed.

Alternatively, it is preferable that an acoustic resistance member having a predetermined acoustic resistance is detachably mounted on the rear acoustic terminal hole communicating with the central opening of the diaphragm.

Further, an additional acoustic terminal hole for introducing sound waves is preferably arranged around the rear acoustic terminal hole of the second condenser element.

Thus, with this configuration of the unidirectional condenser microphone unit according to the present invention, a diaphragm is annular in shape and placed on a rear acoustic terminal side, and the rear acoustic terminal communicates with the central opening.

That is, by closing/opening the rear acoustic terminal communicating with the central opening, sound waves from the rear side are collected via the diaphragm, or collected directly. Thus, depending on the sound collecting situation, it becomes possible to control occurrence of the proximity effect in collecting sound in a low sound range.

Additionally, degree of the proximity effect can also be controlled by varying materials of acoustic resistance materials covering the rear acoustic terminal communicating with the central opening.

Thus, it becomes possible to obtain a unidirectional microphone unit that can collect sounds in a lower frequency range by the proximity effect, even in the case where a diaphragm is placed on a rear acoustic terminal side of the condenser microphone unit.

DESCRIPTION OF THE PREFERRED EMBODIMENTS

Figure 1:
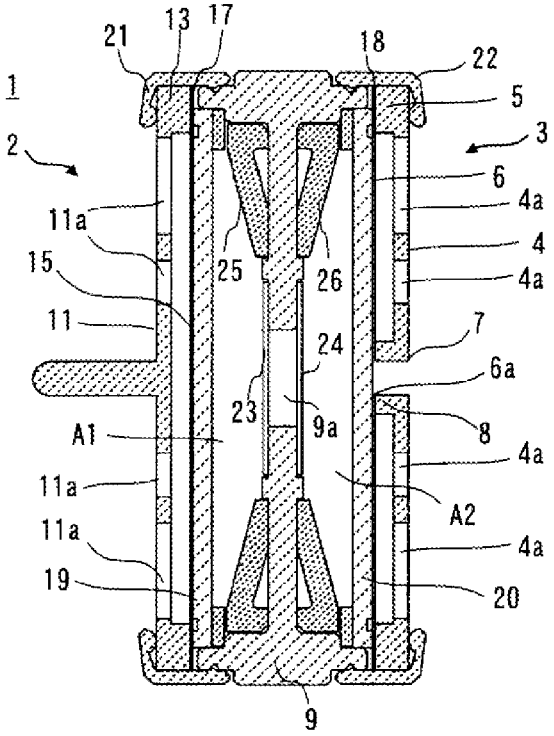
FIG. 1 is a cross-sectional view illustrating a unidirectional microphone unit of a first embodiment of the present invention.
Figure 9:
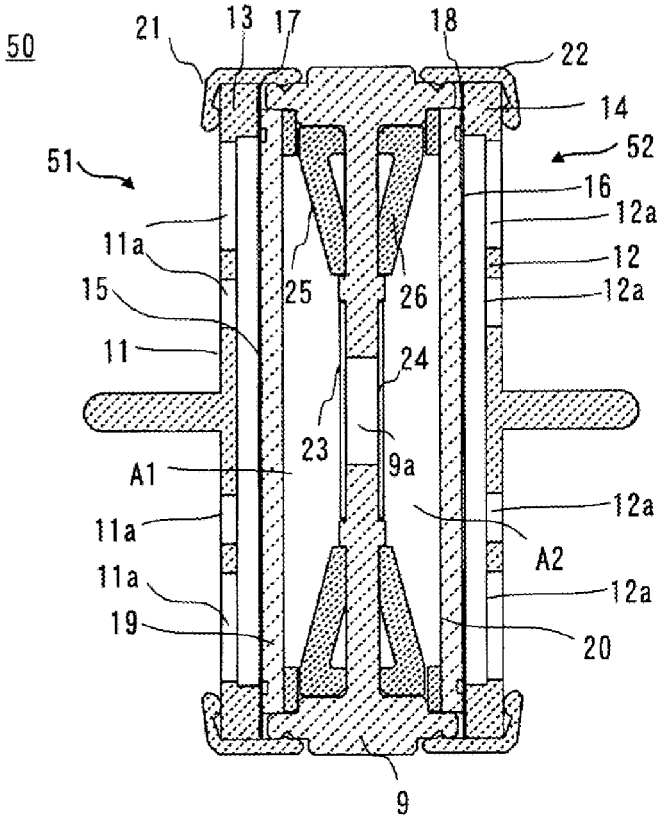
Fig. 9 Prior Art
FIG. 9 is a cross-sectional view of a conventional unidirectional microphone unit.
Figure 10:
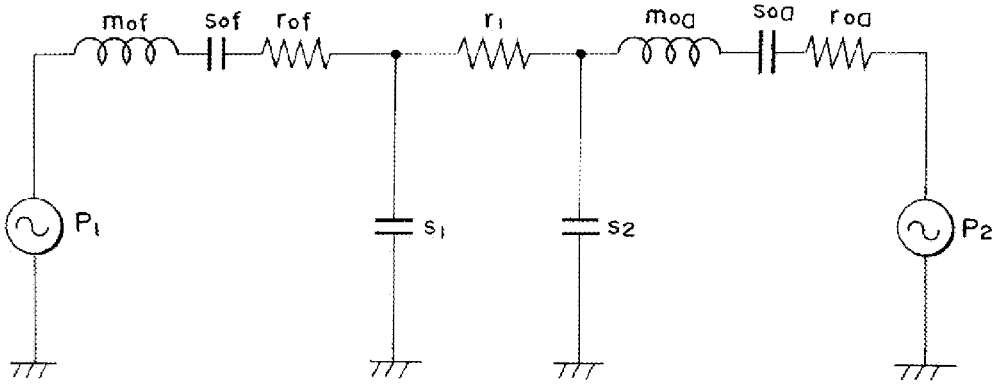
Fig. 10 Prior Art
FIG. 10 is an equivalent circuit diagram of the conventional unidirectional microphone unit shown in FIG. 9.

Hereinafter, an embodiment of the invention will be described with reference to the accompanying drawings. FIG. 1 shows a cross-sectional view illustrating a first embodiment of a unidirectional microphone unit of the present invention. In FIG. 1, reference numbers of component members in the unidirectional condenser microphone unit 1 are the same as those of the corresponding members in the conventional condenser microphone unit already explained with FIG. 9.

The unidirectional condenser microphone unit 1 shown in FIG. 1 includes an electrically insulating base 9 made of synthetic resin or ceramics or the like, and a first and a second condenser elements 2, 3 supported by opposite sides of the insulating base 9.

The condenser elements 2, 3 are disposed laterally symmetrically, but are partly different in configuration. Firstly, the first condenser element 2 includes a diaphragm 15 stretched with a predetermined tension over a support ring 13 formed on a peripheral portion of a resonator 11 made of a metal plate.

The diaphragm 15 is disposed opposite a fixed electrode 19 via a spacer ring 17, and the peripheral portion of the resonator 11 and a peripheral portion of the insulating base 9 are integrally assembled by a connection ring 21.

The diaphragm 15 uses a synthetic resin thin film having a metal-, preferably gold, evaporated film on one side. The fixed electrode 19 is made of a perforated metal plate having a large number of sound holes (not shown). Additionally, an electret dielectric film may be formed on the fixed electrode 19.

The resonator 11 includes an acoustic terminal hole 11*a* for introducing sound waves. A communication hole 9*a* is formed at the center of the insulating base 9, and both sides of the communication hole 9*a* are covered with acoustic resistance materials 23, 24.

An air chamber A1 is formed between the fixed electrode 19 and the insulating base 9 in order to acquire velocity components through the acoustic resistance material 23. In the example shown in FIG. 1, a tapered member 25 is provided on the air chamber side of the insulating base 9. The tapered member 25 forms a conical surface with the acoustic resistance material 23 as an apex part and the peripheral portion of the insulating base 9 as a hem, and consequently the air chamber A1 functions as an acoustic transducer having a speaker-cone-like shape.

On the other hand, the second condenser element 3 has a resonator 4 made of a metal plate, and a cylinder-shaped rear central acoustic terminal hole 7 is formed at the center part of the second condenser element 3. A diaphragm 6 having a donut-like shape (annular diaphragm) is stretch with a predetermined tension over a distal portion of a cylinder-shaped small diameter supporting ring 8 that forms the rear central acoustic terminal hole 7, and a distal portion of a supporting ring 5 formed on a periphery of the resonator 4. That is, the diaphragm 6 has a central opening 6*a* communicating with the rear central acoustic terminal hole 7.

The diaphragm 6 is disposed opposite a fixed electrode 20 via the spacer ring 18. And the peripheral portion of the insulating base 9 and a peripheral portion of the resonator 4 are integrally assembled by a connection ring 22.

The diaphragm 6 uses a synthetic resin thin film having a metal-, preferably gold, evaporated film on one side. The fixed electrode 20 is made of a perforated metal plate having a large number of sound holes. Additionally, an electret dielectric film may be formed on the fixed electrode 20.

The resonator 4 includes an acoustic terminal hole 4*a* around the rear central acoustic terminal hole 7 for introducing sound waves.

Further, an air chambers A2 is provided between the fixed electrode 20 and the insulating base 9 in order to acquire a velocity component through the acoustic resistance material 24. In the example shown in FIG. 1 or 2, a tapered member 26 is disposed on a side face of the air chamber side of the insulating base 9. The tapered member 26 forms a conical surface with the acoustic resistance material 24 as an apex part and the peripheral portion of the insulating base 9 as a periphery, and the air chamber A2 functions as an acoustic transducer having a speaker-cone-like shape.

In thus configured condenser microphone unit 1, when sound source is positioned on a side of the first condenser element 2, sound waves enter to the first condenser unit 2 directly from the rear central acoustic terminal hole 7 without passing through the diaphragm 6 of the second condenser element 3. Consequently, a lower frequency sound waves enter into the first condenser element 2, and proximity effect can be obtained.

The acoustic terminal represents a position of air which effectively provides a sound pressure to the microphone unit 1. In other words, the acoustic terminal is a center position of the air moving through both the acoustic terminal hole 11*a* and the rear central acoustic terminal hole 7 simultaneously (together) with the diaphragm provided in the microphone unit 1. Because the microphone unit 1 is unidirectional, the acoustic terminal includes a front acoustic terminal and a rear acoustic terminal, and the front acoustic terminal is located in front of the diaphragm 15 and the rear acoustic terminal is located behind a back of the diaphragm 6.

Figure 2:
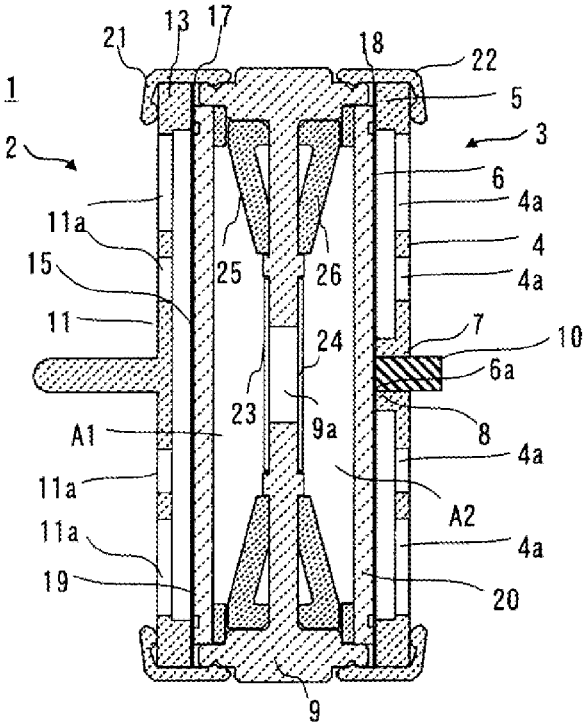
FIG. 2 is a cross-sectional view illustrating a unidirectional microphone unit of a second embodiment of the present invention.

FIG. 2 is a cross-sectional view illustrating a second embodiment of the unidirectional microphone unit according to the present invention.

The second embodiment is different from the first embodiment only in that an acoustic resistance member 10 having a predetermined acoustic resistance is detachably mounted in the supporting ring 8 that forms the rear central acoustic terminal hole 7.

With this configuration, acoustic resistance value of the rear central acoustic terminal hole 7 can be varied by opening/closing the rear central acoustic terminal hole 7 or changing materials of the acoustic resistance member 10.

Figure 3:
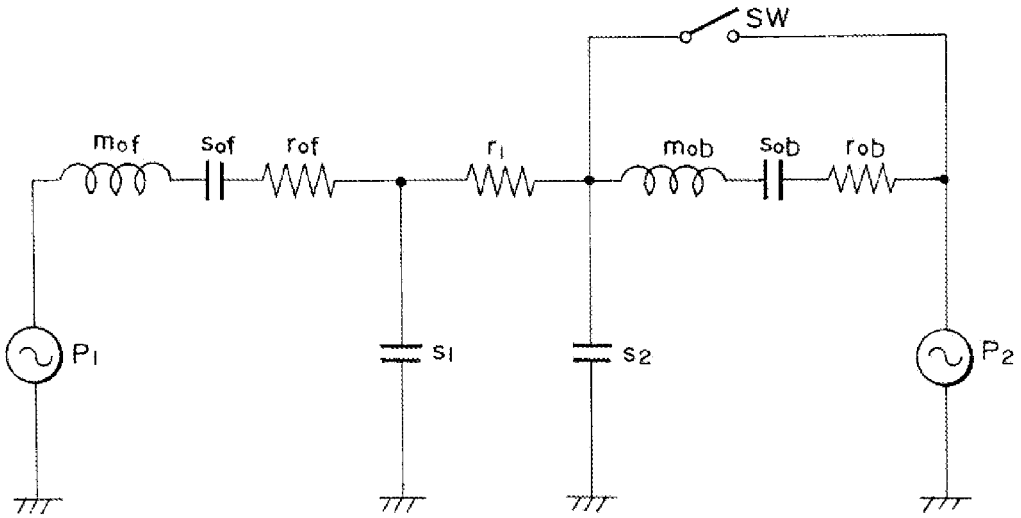
FIG. 3 is an equivalent circuit diagram of the unidirectional microphone unit of FIG. 2 where an acoustic resistance member is detachably mounted thereon.
Figure 4:
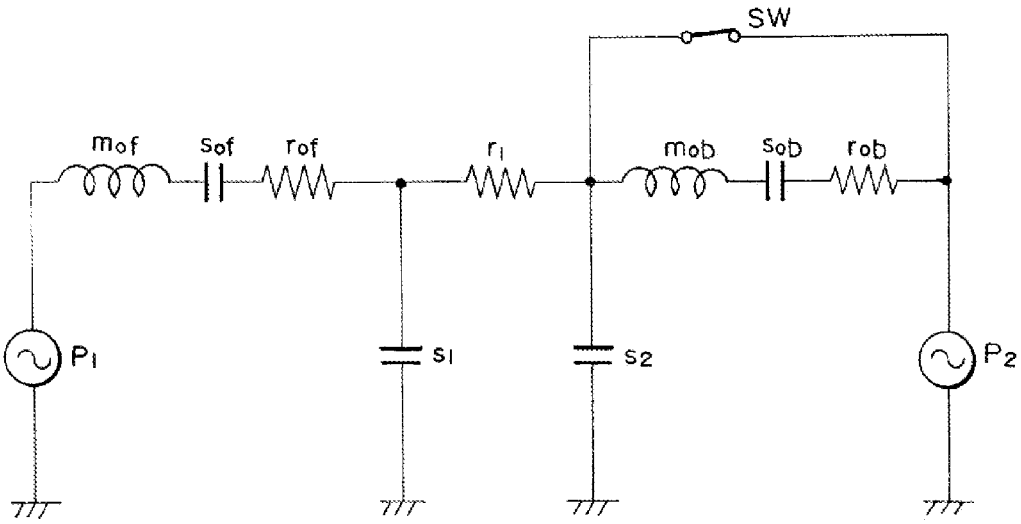
FIG. 4 is an equivalent circuit diagram of the unidirectional microphone unit of FIG. 2 where the acoustic resistance member is detached.

FIGS. 3 and 4 show equivalent circuit diagrams of the condenser microphone unit 1 shown in FIGS. 1 and 2. Let the first condenser element 2, shown in FIGS. 3 and 4, be on a front side, then P1 denotes a sound source on a side of the front acoustic terminal hole 11*a*, $m_0f$ denotes mass of the diaphragm 15, $s_0f$ denotes stiffness of the diaphragm 15, $r_0f$ denotes acoustic resistance, and $s_1$ denotes acoustic mass of the air chamber A1. And P2 denotes a sound source on a side of the rear acoustic terminal hole 4*a* of the second condenser element 3, $m_0b$ denotes mass of the diaphragm 6, $s_0b$ denotes stiffness of the diaphragm 6, $r_0b$ denotes acoustic resistance, and $s_2$ denotes acoustic mass of the air chamber A2. A resultant acoustic resistance of combination of the acoustic resistance materials 23 and 24 is denoted as $r_1$. And the rear central acoustic terminal hole 7 is openable by detaching the acoustic resistance member 10; this open/close mechanism is shown as a switch and denoted as SW. This switch SW is connected in parallel with a series circuit of $m_0b$, $s_0b$ and $r_0b$. The switch is in an open state (OFF state) when the acoustic resistance member 10 is mounted in the rear central acoustic terminal hole 7, and is in a closed state (ON state) when the acoustic resistance member 10 is detached.

In the thus configured condenser microphone unit 1 where the switch SW is closed; that is the acoustic resistance member 10 is detached as shown in FIG. 1, the equivalent circuit becomes as shown in FIG. 4. That is, if the sound source P1 is on the side of the first condenser element 2, and the switch SW is ON, a serial circuit consisting of $m_0b$, $s_0b$ and $r_0b$ is short-circuited, sound waves on the side of the first condenser unit 2 enter directly from the rear central acoustic terminal hole 7 without passing through the diaphragm 6, corresponding to the serial circuit consisting of $m_0b$, $s_0b$ and $r_0b$, of the second condenser element 3.

Therefore, low frequency sound waves come into a side of the first condenser element 2, and the proximity effect can be obtained thereby.

On the other hand, the equivalent circuit becomes as shown in FIG. 3, when the switch SW is open; that is, the acoustic resistance member 10 is mounted and the rear central acoustic terminal hole 7 is lidded therewith as shown in FIG. 2. That is, if the sound source P1 is on the side of the first condenser element 2, and the switch SW is opened; then, sound waves P2 coming from the rear acoustic terminal holes 4*a* toward the first condenser unit 2 enter through the diaphragm 6, corresponding to the serial circuit consisting of $m_0b$, $s_0b$ and $r_0b$, of the second condenser element 3.

Therefore, low frequency sound waves do not go into the side of the first condenser element 2, and the microphone unit operates as omnidirectional in a lower frequency range. Thus, the proximity effect is hardly obtained.

As described the above, according to the first and second embodiments of the present invention, in the condenser microphone unit having a diaphragm on the rear acoustic terminal side, the diaphragm 6 having an annular-shape is disposed on the rear acoustic terminal side so that the rear central acoustic terminal hole 7 is provided without the diaphragm 6.

That is, by closing/opening the rear central acoustic terminal hole 7, sound waves from the rear side are collected via the diaphragm, or collected directly. Thus, depending on the sound collecting situation, it becomes possible to control occurrence of the proximity effect in collecting sounds in a low sound range.

Additionally, degree of the proximity effect can also be controlled by varying the acoustic resistance by selecting materials of the acoustic resistance member 10 covering the rear central acoustic terminal hole 7.

In the embodiments described the above, although a configuration that the acoustic resistant member 10 is mounted in the rear central acoustic terminal hole 7 is given, the invention is not limited to the above embodiments. A lid made of a sound insulating plate member having an opening/closing device may be employed to open/close the rear central acoustic terminal hole 7. In that case, the lid may preferably be capable of changing degree of opening of the rear central acoustic terminal hole 7.

EXAMPLES

The unidirectional condenser microphone unit according to the invention will be described in more detail with reference to examples.

In the examples, unidirectional microphone units as described in the description of the preferred embodiments were manufactured and the characteristics of the microphone units were confirmed through the experiments for measurement.

Examples 1

Figure 5:
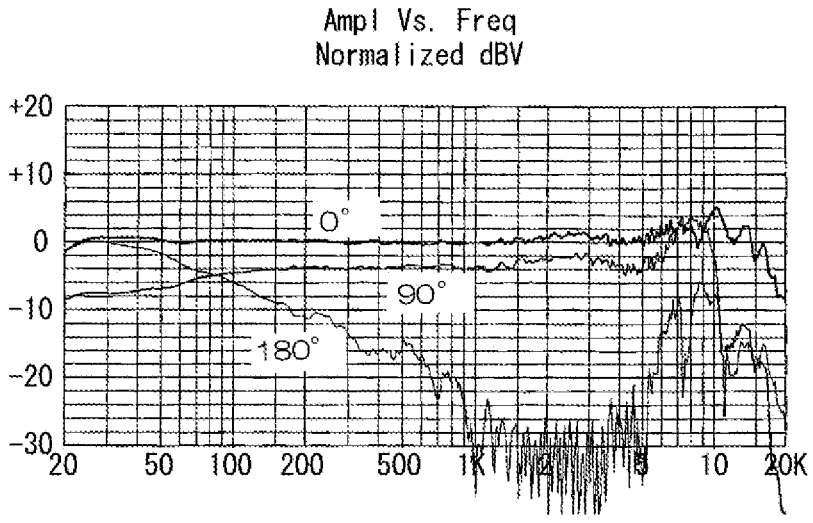
FIG. 5 is a graph showing a result of directional characteristics measurement of the first embodiment of the present invention.

Directionality of a condenser microphone unit having a configuration shown in FIG. 1 was measured under conditions where the rear central acoustic terminal hole was opened, and the measurement distance was 0.5 m (condition 1) and 0.3 m (condition 2). FIG. 5 is a graph showing directionality characteristics measured at directions of 0 degree, 90 degree, and 180 degree under the condition 1, and FIG. 6 is a graph showing directionality characteristics measured at directions of 0 degree, 90 degree, and 180 degree under the condition 2.

Figure 6:
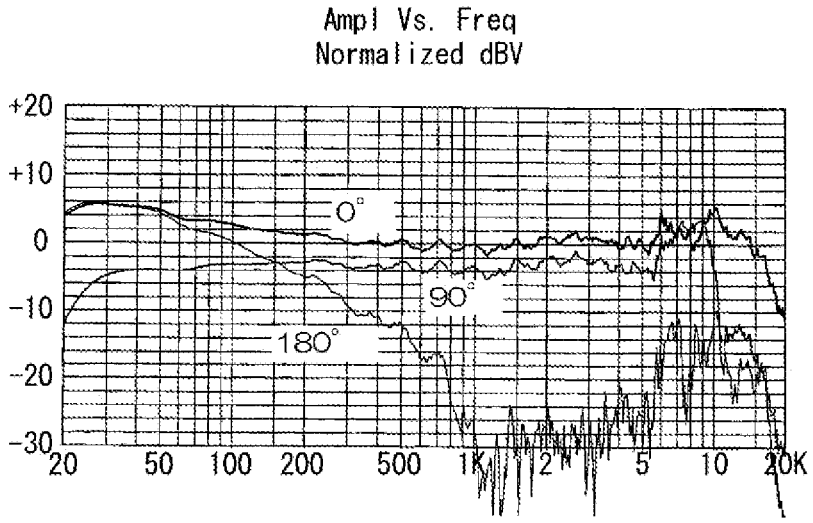
FIG. 6 is a graph showing a result of directional characteristics measurement of the second embodiment of the present invention.

According to the graphs shown in FIGS. 5 and 6, it was confirmed that when sound was collected at a short distance, the condenser microphone unit operates as omnidirectional at lower frequencies and the proximity effect was obtained.

Examples 2

Figure 7:
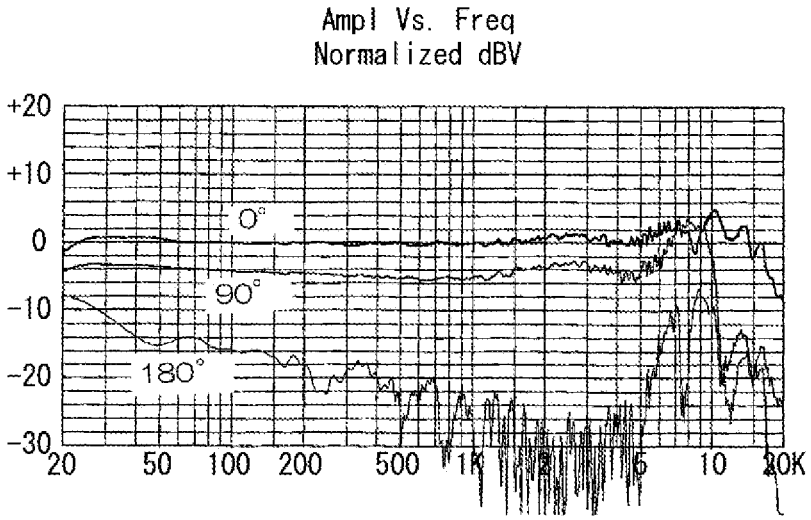
FIG. 7 is a graph showing a result of directional characteristics measurement of comparative example 1.

Directionality of a condenser microphone having a configuration shown in FIG. 2 was measured under conditions that the rear central acoustic terminal hole was closed, and the measurement distance was 0.5 m (condition 3) and 0.3 m (condition 4). FIG. 7 is a graph showing directionality characteristics measured at directions of 0 degree, 90 degree, and 180 degree under the condition 3, and FIG. 8 is a graph showing directionality characteristics measured at directions of 0 degree, 90 degree, and 180 degree under the condition 4.

Figure 8:
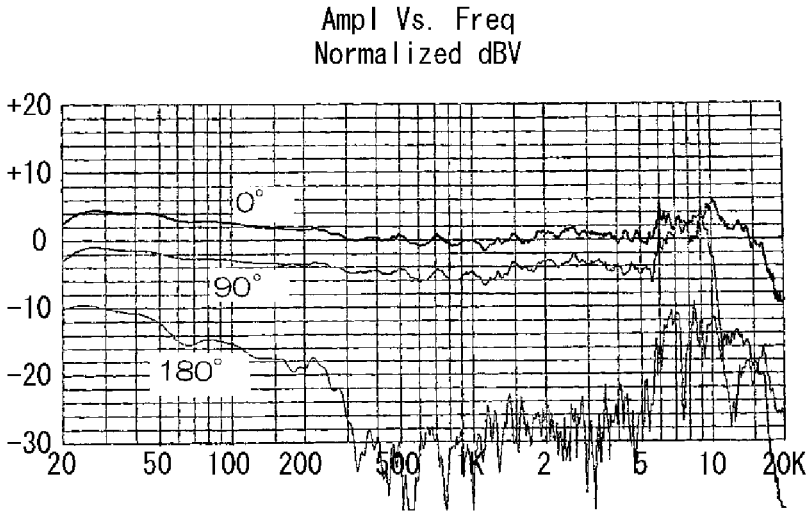
FIG. 8 is a graph showing a result of directional characteristics measurement of comparative example 2.

According to the graphs shown in FIGS. 7 and 8, it was confirmed that when sound was collected at a short distance, the sound level at 180 degree direction is low at lower frequencies and the proximity effect was not obtained.

Effects of the invention were confirmed from the above results.

What is claimed is:

1. A unidirectional condenser microphone unit comprising:

a first condenser element and a second condenser element, each including a diaphragm that is vibrated by sound waves and a fixed electrode having sound holes and disposed opposite the diaphragm;

an insulating base having an opening at a center thereof and configured to support the respective fixed electrodes of the first and second condenser elements at opposite sides of the insulating base;

acoustic resistance materials covering both ends of the opening of the insulating base; and air chambers formed respectively between each of the fixed electrodes and the insulating base, such that respective back sides of the diaphragms of the first and the second condenser elements are acoustically in communication with each other, wherein the diaphragm of the second condenser element is formed to be an annular-shape having a central opening, and the second condenser element has a rear acoustic terminal hole communicating with the central opening.

2. The unidirectional condenser microphone unit according to claim 1, further comprising an opening/closing device for opening/closing the rear acoustic terminal hole communicating with the central opening of the diaphragm.

3. The unidirectional condenser microphone unit according to claim 2, wherein the opening/closing device is configured such that a degree of opening of the rear acoustic terminal hole can be changed.

4. The unidirectional condenser microphone unit according to claim 1, further comprising an acoustic resistance member having a predetermined acoustic resistance detachably mounted on the rear acoustic terminal hole communicating with the central opening of the diaphragm.

5. The unidirectional condenser microphone unit according to claim 1 further comprising an acoustic terminal, arranged around the rear acoustic terminal hole of the second condenser element, for introducing sound waves.

* * * * *